US005796042A

United States Patent [19]

Pope

[11] Patent Number: 5,796,042

[45] Date of Patent: Aug. 18, 1998

[54] COAXIAL CABLE HAVING A COMPOSITE METALLIC BRAID

[75] Inventor: Bradley Gene Pope, Richmond, Ind.

[73] Assignee: Belden Wire & Cable Company, Richmond, Ind.

[21] Appl. No.: 667,243

[22] Filed: Jun. 21, 1996

[51] Int. Cl.[6] ..... H01B 7/28

[52] U.S. Cl. ..... 174/102 SP; 174/121 A

[58] Field of Search ..... 174/34, 102 SP, 174/102 P, 121 A, 126.4

[56] References Cited

U.S. PATENT DOCUMENTS

| | | | |
|---|---|---|---|
| 3,643,007 | 2/1972 | Roberts et al. | 174/36 |
| 4,245,134 | 1/1981 | Oldham et al. | 174/88 C |
| 4,703,998 | 11/1987 | Uchioke et al. | 350/96.23 |
| 5,000,539 | 3/1991 | Gareis | 174/70 R |
| 5,003,126 | 3/1991 | Fujii et al. | 174/36 |
| 5,132,491 | 7/1992 | Mulrooney et al. | 174/36 |
| 5,261,886 | 11/1993 | Chesterfield et al. | 606/228 |
| 5,642,452 | 6/1997 | Gravely et al. | 385/113 |

*Primary Examiner*—Kristine L. Kincaid
*Assistant Examiner*—Marc D. Machtinger
*Attorney, Agent, or Firm*—Laff, Whitesel, Conte & Saret, Ltd.

[57] ABSTRACT

Coaxial cables having a composite braid with a plurality of water expandable strands of yarn woven therein, preferably to quad coaxial cables having the inner metallic braid as the metallic composite braid. The composite braid has a plurality of woven metallic strands, at least one first strand of water-blocking yarn helically wound in one direction and extending along the length of the composite braid, the at least one first strand being woven into the metallic strands of the composite braid, at least one second strand of water-blocking yarn helically wound in an opposite direction with metallic strands of the composite braid and extending along the length of the composite braid, the first and second water-blocking strands of yam crossing over and contacting each other at a plurality of spaced yarn contact points and said first and second water-blocking strands of yarn being water-expandable.

15 Claims, 1 Drawing Sheet

COAXIAL CABLE HAVING A COMPOSITE METALLIC BRAID

BACKGROUND OF THE INVENTION.

The present invention relates to cables having metallic braids. More particularly, the present invention relates to cables having a metallic composite braid with a plurality of water-expandable strands of yarn woven therein.

Cables with metallic braids and especially coaxial generally have a problem with water flowing through the cables along the woven metallic braids thereof. The water follows the metallic woven strands through the cable.

Generally, water is prevented from flowing through the cables along the tubular metallic braids by utilizing an appropriate flooding compound. When the cables are stripped for installations, and even when the cables are manufactured, there are clean-up and contamination problems with the exposed flooding compound. It would aid in the installation and use of these cables if the amount of flooding compounds can be reduced, and in some instances, eliminated.

SUMMARY OF THE INVENTION.

Therefore, it is an object of the present invention to substantially reduce, and in some instances, eliminate the need for a flooding compound by utilizing a metallic composite tubular braid in a cable and especially in a quad coaxial cable. The composite braid has a plurality of water expandable strands of yarn interwoven therein in opposite directions so as to provide yarn cross-over points which act as a dam in preventing the water from flowing through the cable.

It is another object of the present invention to provide a cable having a dielectric surrounding a central conductor and having , at least one metallic composite braid wherein the composite braid has a plurality of interwoven metallic strands and at least two water expandable yarn strands interwoven with the metallic strands to provide a plurality of yarn cross-over points.

It is another object of the present invention to provide quad shield coaxial cable having central conductor, a dielectric surrounding the central conductor, a first metallic shielding tape surrounding the dielectric, a first metallic braid surrounding the first shielding tape, a second shielding tape surrounding the first metallic braid, a second metallic braid surrounding the second shielding tape, the first metallic braid being a metallic composite braid formed by a plurality of woven metallic strands, at least one first strand of water-expandable yarn helically wound in one direction with the metallic strands and extending along the length of the cable, at least one second strand of water-expandable yarn helically wound in the opposite direction with the metallic strands and extending along the length of the cable, the first and second yarn crossing over and contacting each other at a plurality of spaced yarn contact or cross-over points.

It is still a further object of the present invention to provide a composite braid for use with cables having a plurality of woven metallic strands and at least two water-expandable strands of yarn interwoven with the metallic strands to provide a plurality of yarn cross-over points.

The objects and advantages of the present invention will become more apparent upon consideration of the following detailed description when taken in conjunction with the accompanying drawings.

DESCRIPTION OF THE INVENTION

Figure 1:
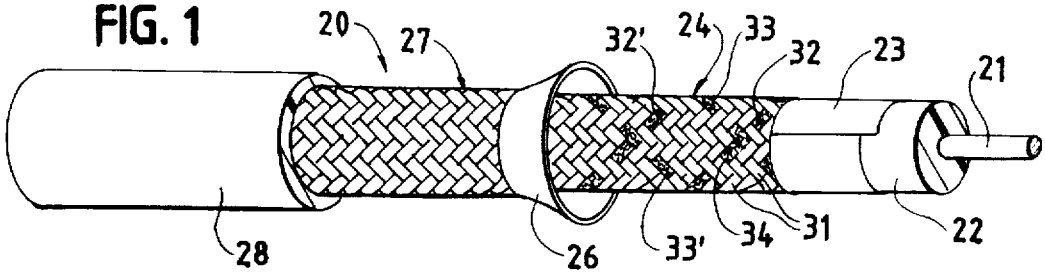
FIG. 1 is a perspective view of a coaxial cable of the present invention.

FIG. 1 illustrates a quad shield coaxial cable 20 having a central conductor 21 surrounded by an appropriate dielectric 22. Surrounding the dielectric 22 is first conductive shield 23. Surrounding the first conductive shield 23 is a first metallic braid 24. A second conductive shield 26 surrounds the first metallic braid 24. A second metallic braid 27 surrounds the second conductive shield 26. The cable has a jacket 28 surrounding the second metallic braid 27.

The conductor 21 may be any appropriate single or plural conductors and may even be an optical fiber. The most common conductors are either solid or stranded copper wire, tinned copper wire, copper-covered steel, silver-plated copper or copper alloy and nickel-plated copper or copper alloy.

The insulation or dielectric 22 is likewise, any appropriate dielectric and preferred dielectrics are selected from polyethylene, FEP TEFLON® (fluorinated ethylene-propylene), TFE TEFLON® (tetrafluoroethylene), other TEFLON®, flame retardant polyethylene and fluorocopolymers. The dielectric may be foamed or partially foamed if desired.

The shields 23 and 26 are generally longitudinally wrapped as shown and may have an appropriate Z-Fold ®. The conductive shields 23 and 26 are generally metallic tape or a metallic foil or a conductive epoxy resin. The metallic tape usually has metallic foil or coating on one or both sides of a polyester core. Generally the metallic is aluminum but may be any other metallic such as copper, tinned copper and so forth.

The metallic strands for the braids 24 and 27 are generally prepared from woven strands of copper, silver-coated copper, tinned copper, copper-coated steel, silver-coated copper or aluminum.

The jacketing material may be polyvinylchloride, polyethylene, high density polyethylene, FEP TEFLON®, fluorocopolymer, flame retardant polyethylene or a chlorosulfinated polyethylene.

The metallic braid 24 is a composite tubular metallic braid having woven metallic strands 31 and four strands of water-expandable yarn 32, 32', 33 and 33'. The yams 32 and 32' are wound helically in one direction for the length of the composite braid 24.

The water-expandable strands of yam 33 and 33' are helically wound in the opposite direction as the strands of yam 32, 32' and extend the length of the composite braid 24. The strands of yarn 32, 32', 33, 33' are woven into the metallic strands at the time the braid is woven. An appropriate water expandable yarn is one which is made from a polyester swellable fiber. The yarn has less than ten percent moisture content and preferably no more than seven percent moisture content.

Suitable water-expandable polyester fiber yarn was obtained from Lantor, Inc., and the yam had sodium polyacrylate powder coated thereon.

The strands of yarn 32, 32' are interwoven in one direction and the strands of yam 33, 33' are woven in the opposite direction. The yarns 32, 32' are spaced from one another and in many instances extend parallel to each other.

The strands of yarn 33 and 33' are also spaced from one another and also, in many instances, extend parallel to each other.

The strand of yarn 32 will intersect the strands of yarn 33 and 33' and the strand of yarn 16' will also intersect the strands of yarn 33 and 33' to provide a plurality of yarn cross-over points 34.

The strands of yarn are woven into the braid is so as to provide at least two yarn cross-over points or contact and intersecting points between the strands of yarn per 0.735 inches based on RG54 construction with 40% braid coverage, 17.5° angle and 1.47 inches carrier lay length.

The quad shield coaxial cable is a preferred embodiment of the invention and the composite braid, works well with a quad cable. The interwoven strands of yarn create a water blocking effect. The yarn cross-over points create a dam effect when the water attempts to flow through the braid. Although FIG. 1 shows only metallic braid 24 as being a composite braid, metallic braid 27 may also be a composite braid.

The use of the composite braid will substantially reduce and in some instances eliminate the need for a flooding compound to be used with the braid to prevent water from flowing through the cable.

Figure 2:
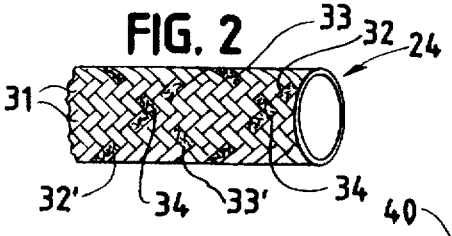
FIG. 2 is a perspective view of the composite braid shown in the cable of FIG. 1.

Referring to FIG. 2, there is shown the tubular metallic composite braid 24 constructed according to the present invention. The composite braid 24 may be sold per se for use in coaxial cables. The composite braid 24 has a general tubular construction and when in its circular form has an inner diameter of approximately about 3 to about 20 millimeters.

The braid 24 is made up of woven metallic strands 31 and the water-expandable strands of yarn 32, 32', 33 and 33'.

As stated above, the strands of yarn 32, 32' are interwoven with the metallic strands 31 in one direction and the strands of yarn 33, 33' are interwoven with the metallic strands 31 in the opposite direction to provide the plurality of yarn cross-over points 34.

Figure 3:
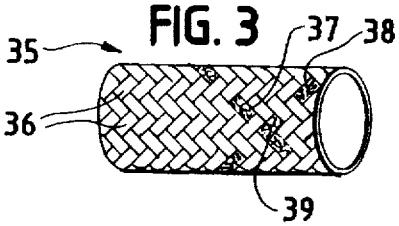
FIG. 3 is a perspective view of another composite braid of the present invention.

FIG. 3 illustrates a tubular metallic composite braid 35 constructed according to the present invention. The composite braid 35, also may be sold per se for use in coaxial cables. The composite braid 35 has a general tubular construction and when in its circular form has an inner diameter of approximately about 3 to about 20 millimeters. The braid 35 is made up of woven metallic strands 36 and two water expandable yarns 37 and 38.

The first strand of water-expandable yarn 37 is interwoven with the metallic strands 36 helically extend in one direction and a second strand of water expandable yarn 38 is interwoven with the metallic strands to helically extend in the opposite direction. The strands of yarn 37 and 38 intersect and contact each other several times along the length of the composite braid 36 to provide several yarn cross-over points 39 (only one is shown for illustrative purposes).

There are at least 2 yarn cross-over points per 0.735 inches length of the composite braid based on RG59 construction with 40% minimum braid coverage, 17.5° angle and 1.49' carrier lay length.

Figure 4:
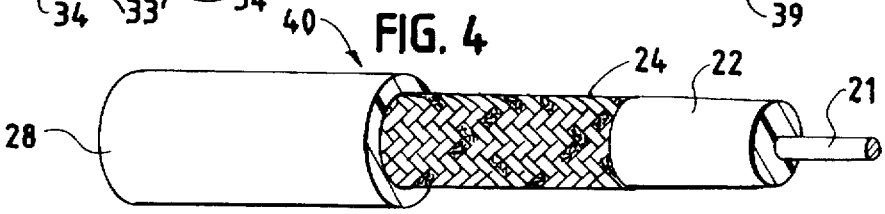
FIG. 4. is a perspective view of an alternative coaxial cable of the present invention.

FIG. 4 metallic coaxial cable 40 has a central conductor 21 surrounded by an appropriate dielectric 22. The metallic composite braid 24 surrounds the dielectric 22 and a jacket 28 surrounds the composite braid.

Figure 5:
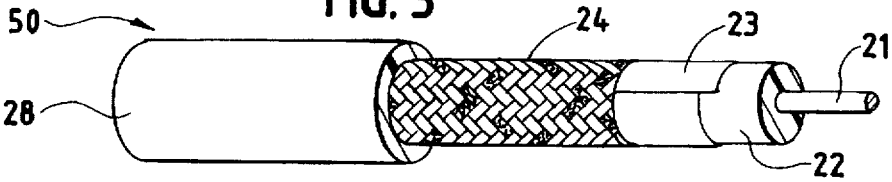
FIG. 5 is a perspective view of still another coaxial cable of the present invention.

FIG. 5 shows another coaxial cable 50 according to the present invention. This coaxial cable 56 has a single metallic braid. The coaxial cable 50 has a central conductor 21 surrounded by a dielectric 22. The dielectric 22 is surrounded by the conductive shield 23. The conductive shield 23 is then surrounded by the metallic composite braid 24 and the composite braid 24 is surrounded by the cable jacket 28.

Figure 6:
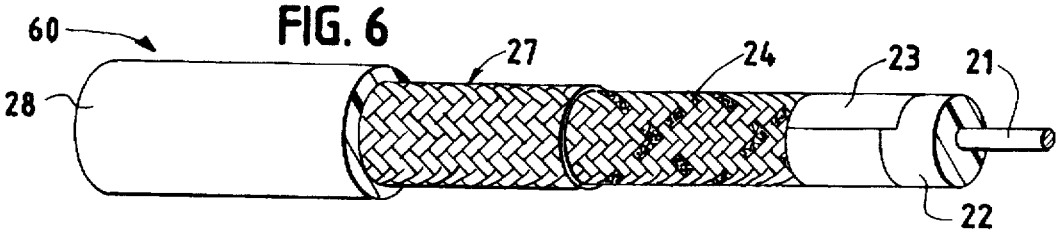
FIG. 6 is a perspective view of another coaxial cable of the present invention.

FIG. 6 illustrates still another coaxial cable 60 of the present invention. The coaxial cable 60 has a central conductor 28 surrounded by a dielectric 22. The dielectric 22 is surrounded by a metallic composite braid 24 and the composite braid 24 is surrounded by a second metallic metallic braid 27. The metallic braid 27 may be substituted with a metallic composite braid if desired for certain uses.

The metallic braid 27 is then surrounded by a cable jacket 28.

Figure 7:
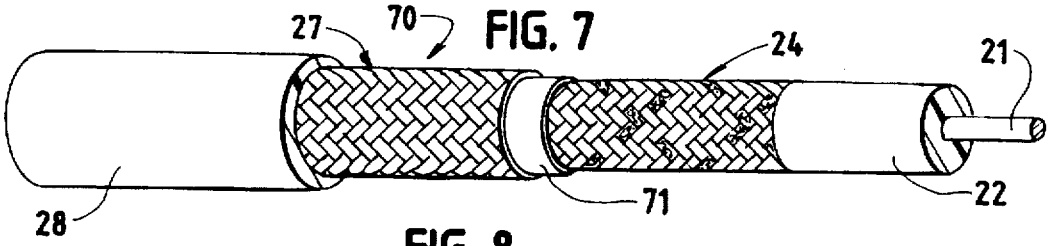
FIG. 7 is a perspective view of a further coaxial cable of the present invention.

FIG. 7 illustrates a further coaxial cable 70 of the present invention. The coaxial cable 70 has a central conductor 21 surrounded by a dielectric 22. The dielectric 22 is surrounded by a metallic composite braid 24. The composite braid 24 is surrounded by a second dielectric 71. The second dielectric 71 is surrounded by a metallic braid 27. The metallic braid 27 may also be an appropriate metallic composite shield. The second dielectric 71 is selected from the same material which can be used for the first dielectric 22.

Figure 8:
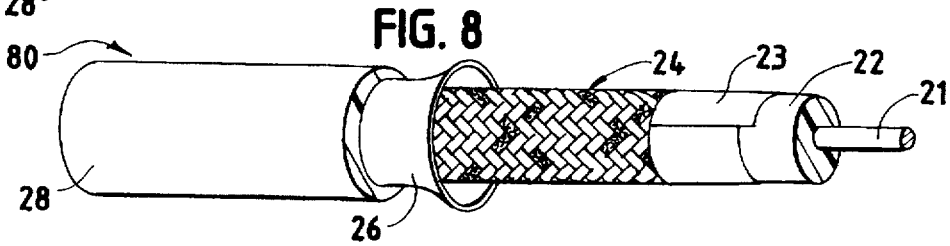
FIG. 8 is a perspective view of a further coaxial cable of the present invention.

FIG. 8 illustrates a further tri-shield coaxial cable 80 of the present invention having a central conductor 21, dielectric 22, conducting shield 23, metallic composite braid 24, second conducting shield 27 and cable jacket 28.

In the above description, we have used the same numerals to indicate the same item. That is, composite braid 24 is constructed in the same manner for cables 20, 40, 50, 60 and 70. Of course, composite braid 35 may be substituted for composite braid 24 depending on the particular function of the coaxial cable.

The foregoing description is for purposes of illustration only and is not intended to define the scope of the invention. The scope of protection is to be measured by the following claims.

I claim:

1. A coaxial cable comprising: a central conductor, a dielectric surrounding said conductor, at least one metallic braid surrounding said dielectric and a cable jacket surrounding said at least one metallic braid, said at least one metallic braid being a composite braid, said composite braid being a plurality of interwoven metallic strands and at least two water expandable strands of yarn interwoven with the metallic stands to provide a plurality of yarn cross-over points.

2. The coaxial cable of claim 1 wherein the strands of yarn extend substantially the length of said composite braid.

3. The coaxial cable of claim 2 wherein said coaxial cable has a second metallic braid surrounding said composite braid which is made of a second plurality of interwoven metallic strands, and said second metallic braid is concentric with said composite braid.

4. The coaxial cable of claim 2 wherein there is a conductive shield between said dielectric and said composite braid.

5. The coaxial cable of claim 4 wherein said cable has a second metallic braid, and a second conductive shield, the second metallic braid exterior to said composite braid and interior to said cable jacket the second conductive between said composite braid and said second metallic braid.

6. The coaxial cable of claim 3 wherein said second metallic braid is a second metallic composite braid having at least two additional water expandable strands of yarn interwoven with the metallic strands of said second metallic composite braid to provide a plurality of yarn cross-over points on said second composite braid.

7. The coaxial cable of claim 5 wherein each of said conductive shields are conductive shielding tape.

8. In a conductive cable, a metallic braid being a composite braid, said composite braid being a plurality of interwoven metallic strands and at least two water expandable strands of yarn interwoven with the metallic strands to provide a plurality of yarn cross-over points.

9. In the conductive cable of claim 8, the strands of yarn extending substantially the length of said composite braid.

10. In the conductive cable of claim 9, said strands of yarn having a maximum water content of 10%.

11. A coaxial cable comprising a central conductor, a dielectric surrounding said conductor, a first metallic shielding tape surrounding said dielectric, a first metallic braid surrounding said first shielding tape, a second shielding tape surrounding said first metallic braid, a second metallic braid surrounding said second shielding tape, at least one of said first and second metallic braids being a composite braid, said composite braid having a plurality of woven metallic strands, at least one first strand of water-expanding yarn helically wound in one direction and extending along the length of the composite braid, said at least one first strand of yarn being woven with said metallic strands into said composite braid, at least one second strand of water-expandable yarn helically wound in an opposite direction and extending along the length of the composite braid, said first and second strands of yarn crossing over and contacting each other at a plurality of spaced yarn contact points.

12. The coaxial cable of claim 11 wherein the first and second water-expandable strands of yarn have a maximum water content of 10%.

13. A composite braid for use with conductive cables comprising a plurality of woven metallic strands and at least two water-expandable strands of yarn interwoven with said metallic strands to provide a plurality of yarn cross-over points.

14. The composite braid of claim 13 wherein said water expandable strands of yarn are prepared from synthetic fibers and have a maximum water content of 10%.

15. The composite braid of claim 14 wherein said metallic strands are selected from the group consisting of copper, silver-coated copper, tinned copper, copper-coated steel, silver-coated copper, and aluminum.

* * * * *

UNITED STATES PATENT AND TRADEMARK OFFICE

CERTIFICATE OF CORRECTION

PATENT NO. : 5,796,042
DATED : August 18, 1998
INVENTOR(S) : Bradley Gene Pope

It is certified that error appears in the above-indentified patent and that said Letters Patent is hereby corrected as shown below:

Column 3, Line 14, delete "16'" and insert --32'--
Column 4, Line 8, delete "56" and insert --50--
Column 4, Line 16, delete "28 and insert --21--
Column 4, Line 56, delete "stands" and insert --strands--
Column 5, Line 4, insert--shield-- between "conductive" & "between"

Signed and Sealed this

Second Day of March, 1999

*Attest:*

Q. TODD DICKINSON

*Attesting Officer*

*Acting Commissioner of Patents and Trademarks*